US005536609A

United States Patent [19]

Jackson et al.

[11] Patent Number: 5,536,609

[45] Date of Patent: Jul. 16, 1996

[54] IMPROVED THERMAL ASSISTED TRANSFER METHOD AND APPARATUS

[75] Inventors: David R. Jackson, Rochester; Donald S. Rimai; Robert E. Zeman, both of Webster, all of N.Y.

[73] Assignee: Eastman Kodak Company, Rochester, N.Y.

[21] Appl. No.: 712,017

[22] Filed: Jun. 7, 1991

[51] Int. Cl.[6] ..... G03G 13/01

[52] U.S. Cl. ..... 430/47; 430/42; 430/45

[58] Field of Search ..... 430/47, 45, 42

[56] References Cited

U.S. PATENT DOCUMENTS 4,531,825 7/1985 Miwa et al. ..... 355/3 TR
4,927,727 5/1990 Rimai et al. ..... 430/99
4,968,578 11/1990 Light et al. ..... 430/126
5,019,862 5/1991 Nakamura et al. ..... 355/208
5,089,363 2/1992 Rimai et al. ..... 430/47

*Primary Examiner*—Mark Chapman
*Attorney, Agent, or Firm*—Leonard W. Treash, Jr.

[57] ABSTRACT

A toner image is transferred to a heat softened thermoplastic outer layer of a receiving sheet. The toner is transferred from an image member predominantly by heating the receiving sheet to a temperature which both softens the thermoplastic layer and, when the thermoplastic layer contacts the toner, sinters the toner sufficiently to cause toner to adhere both to the thermoplastic layer and to other particles of toner. To prevent blistering, the temperature to which the thermoplastic layer must be raised can be lowered, for example, to 100 degrees C. by also heating the image member to a temperature, above ambient, but less than the temperature that would either do damage to the image member or cause the toner to stick to it.

13 Claims, 4 Drawing Sheets

IMPROVED THERMAL ASSISTED TRANSFER METHOD AND APPARATUS

TECHNICAL FIELD

This invention relates to the transfer of electrostatically produced toner images to a receiving sheet having a heat softenable outer surface.

BACKGROUND ART

U.S. Pat. No. 4,927,727, Rimai et al, issued May 22, 1990 and U.S. Pat. No. 4,968,578, Light et al, issued Nov. 6, 1990, describe a process for transferring one or more toner images to a receiving sheet in which the receiving sheet is heated prior to transfer. In some embodiments, the receiving sheet has a thermoplastic, heat softenable outer layer which is carefully heated, for example, by radiant heating prior to entering a nip, so that it is softened and is hot enough to sinter the toner contacting it at least where the toner particles contact each other. In this process, some of the particles of toner embed slightly in the thermoplastic layer and some of them do not. The ones that do not embed, sinter at the points of contact between the toner particles which is sufficient to transfer the toner without overall melting of the toner itself. Very high transfer efficiencies have been accomplished with this method.

U.S. patent application Ser. No. 07/405,258, TONER FIXING METHOD AND APPARATUS AND IMAGE BEARING RECEIVING SHEET, Rimai et al, and U.S. patent application Ser. No. 07/405,175, METHOD AND APPARATUS FOR TEXTURIZING TONER IMAGE BEARING RECEIVING SHEETS AND PRODUCT PRODUCED THEREBY, Aslam et al, are directed to fixing such a toner image by a combination of heat and pressure using a ferrotyping web and also to approaches for texturizing the image surface. In these applications, there is also disclosed the advantage of putting a curl preventing layer on the side of the receiving sheet opposite from the embedding layer, which curl preventing layer has a higher melting temperature than the layer in which the toner is embedded. The curl preventing layer is generally a thermoplastic, for example, a polyethylene, or polypropylene that has a relatively high melting point and therefore is less likely to offset when heated than would be a polyester or polystyrene or similar material used for the embedding layer.

The problem of blistering in a receiving sheet is a condition experienced in fusing apparatus. In general, moisture in paper will turn into steam as the temperature of the paper passes 100 degrees C. The steam expands and blisters an impervious outer layer on the paper that tends to stand in its way of escaping. Both the curl preventing layer and the thermoplastic embedding layer prevent the escape of steam and are therefore subject to blistering.

U.S. patent application Ser. No. 07/484,339 to Johnson et al, HEAT ASSISTED TONER TRANSFERRING METHOD AND APPARATUS, filed Feb. 26, 1990, discloses an improvement in the transfer process in which the heat for transfer is provided entirely from within the transfer roller. To prevent offset of the curl preventing layer and also to help reduce blistering, the transfer drum is entirely metallic which provides an extremely tight temperature control in heating the receiving sheets allowing temperatures associated with the thermoplastic layer to be in the 100 to 110 degrees C. range without overshoots of temperature that would cause melting of the curl preventing layer. Since the photoconductive layer is generally coated or wrapped on a metallic drum or roller, the transfer nip is a nip between two hard rollers or drums which is inordinately narrow for conventional transfer. However, contrary to expectations, the advantages gained with two metallic rollers exceeded the disadvantages of the narrow nip and superior results were obtained compared to transfer with a compliant outer surface on the transfer roller.

STATEMENT OF THE INVENTION

It is the object of the invention to provide a method and apparatus of heat assisted transfer of toner particles in which the tendency of the receiving sheet to blister is reduced.

This and other objects are accomplished by a method and apparatus in which both the receiving sheet and the image member are heated. The image member, for example, a photoconductive layer on a drum, is heated to a temperature which is above ambient but low enough that it will not adversely affect the photoconductive characteristics of the photoconductor and will not cause any sticking of the toner to the photoconductor. For example, a temperature between 30 and 45 degrees C. on an inverse composite organic photoconductor does not cause substantial dark decay of charge on the photoconductive surface, nor will it cause extra adherence of the toner to the photoconductor using, for example, a typical polyester base toner having a softening point above 45 degrees C.

With the image member heated to this intermediate temperature, the receiving sheet can be heated somewhat less than would be necessary with an ambient temperature image member. For example, with an ambient temperature image member, we found it necessary with the above-mentioned materials to raise the temperature of the receiver to above 110 degrees C. to obtain highest efficiency transfer. With an image member that has been heated to 30–45 degrees C., we found that the same quality of transfer could be obtained with a receiver at between 100 and 110 degrees C. The difference of 10 degrees C. on the receiver is significant in terms of its effect on blistering. Although the boiling point of water is 100 degrees C., substantial blistering does not occur until some incremental amount of temperature above that point. Thus, with a smaller amount of heat added to the image member, blistering can be greatly reduced in this process. This invention also widens the margin of error in preventing offset of the curl preventing layer onto the transfer drum.

These favorable results are achieved with a hard metallic transfer drum and a hard metallic substrate for the image member. With such materials, control of the temperature of the receiver is most easily maintained and freedom from hot offset of the curl preventing layer and blistering easiest to achieve. However, using a moderately heated image member, the temperature of the curl preventing layer and the paper substrate can be reduced enough that a thin compliant layer can be used on the transfer drum. With such a layer, temperature control is poorer than with a metallic transfer roller. However, with a compliant layer on the transfer drum, evenness of pressure and time of pressure application are greatly increased. Thus, according to a preferred embodiment of the invention, with moderate heating of the image member, use of a slightly compliant transfer drum is feasible with many materials. The invention allows the process to gain the advantages of such a drum, but without the blistering and offset encountered without heating the image member.

BRIEF DESCRIPTION OF THE DRAWINGS

In the detailed description of the preferred embodiment of the invention presented below, reference is made to the accompanying drawings, in which.

BEST MODE OF CARRYING OUT THE INVENTION

This invention is an improvement to the invention disclosed in the above-mentioned U.S. Pat. Nos. 4,927,727 and 4,968,578, which patents are incorporated by reference herein. In general, the receiving sheets, the imaging members and toners disclosed in examples in those applications can be used in the practice of this invention, particularly the examples disclosed in those patents in which the top surface of the receiving layer is heat softened to assist in the transfer process. Naturally, some adjustment of temperature and pressure will be necessary with various of the materials.

Figure 1:
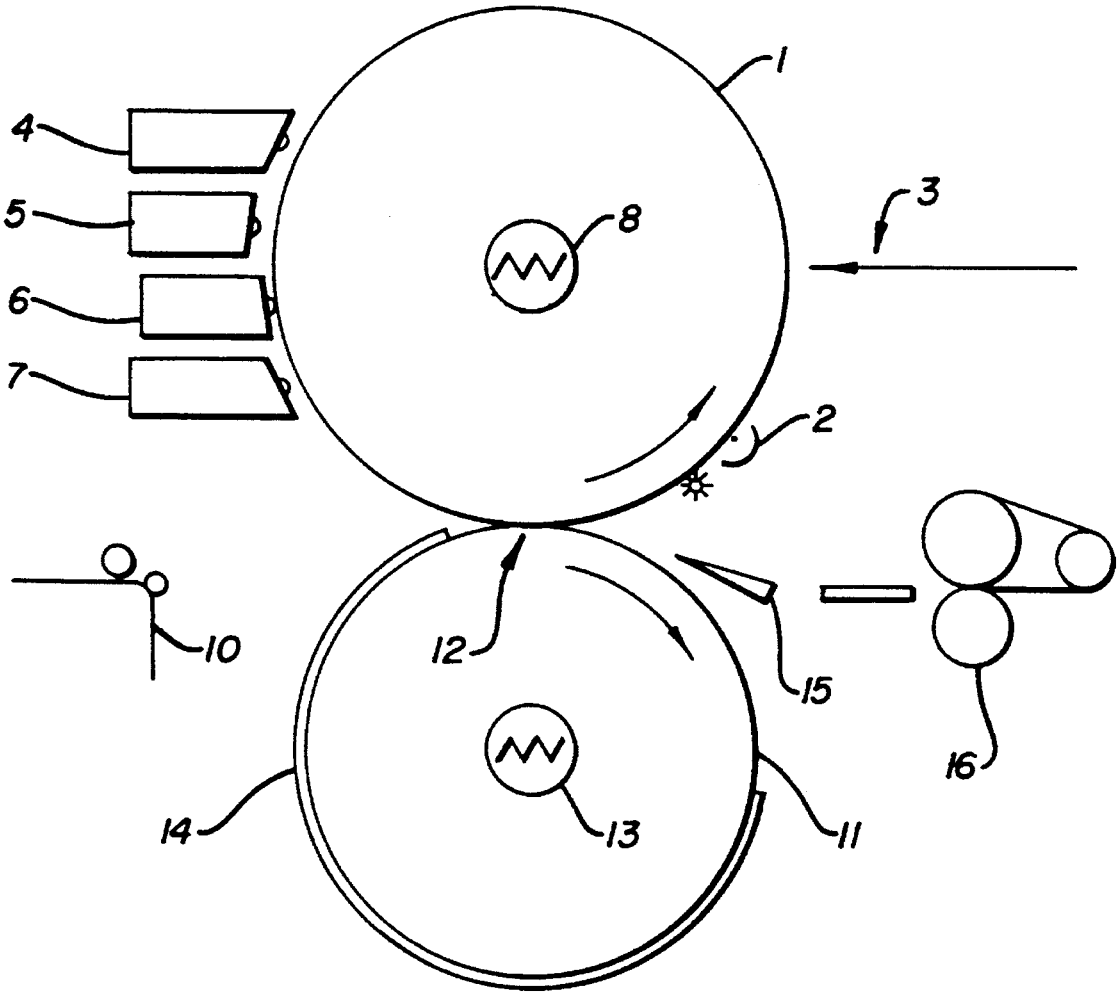
FIG. 1 is a schematic side view of an electrophotographic apparatus illustrating the invention.

According to FIG. 1 a series of single color toner images are formed on an image member 1 using conventional color electrophotography. More specifically, an image member, which can be a photoconductive drum 1, is uniformly charged at a charging station 2 and imagewise exposed by an exposure device, for example, a laser 3, to form an electrostatic image which is representative of a color separation ultimately to be used to form a multicolor image. Each of a series of such electrostatic images are toned by a different one of toner stations 4, 5, 6 or 7 to create a series of different color toner images. As disclosed in said above-mentioned patents, high-quality color images can be obtained by using very fine particle toner, for example, toners having a mean particle size less than 8 microns, including a size less than 4 microns. Typically, they have a glass transition temperature between 45 and 70 degrees C.

A receiving sheet is fed from a receiving sheet supply 10 to a transfer roller or drum 11 to which it is secured by conventional means, for example, by vacuum, holding fingers, or electrostatics. Drums 1 and 11 are rotated at a common peripheral speed through a transfer zone defined by a nip 12. Drum 11 is heated internally by a suitable heating structure, for example, a lamp 13. The combination of heat and pressure causes the toner image to transfer to the top surface of the receiving sheet 14 as it passes through the nip. As will be described with respect to both FIGS. 1 and 2, image member 1 is also heated by a heating source in its center, for example, a lamp 8 controlled by a sensor 28.

Successive different color toner images are transferred in registration to the receiving sheet 14 to form a multicolor image thereon. The receiving sheet 14 is separated from drum 11 by a skive 15 which is moved into position at the appropriate time and the receiving sheet is then fed to a finishing device 16 which uses a combination of pressure and heat to fix the image to the receiving sheet.

Figure 2:
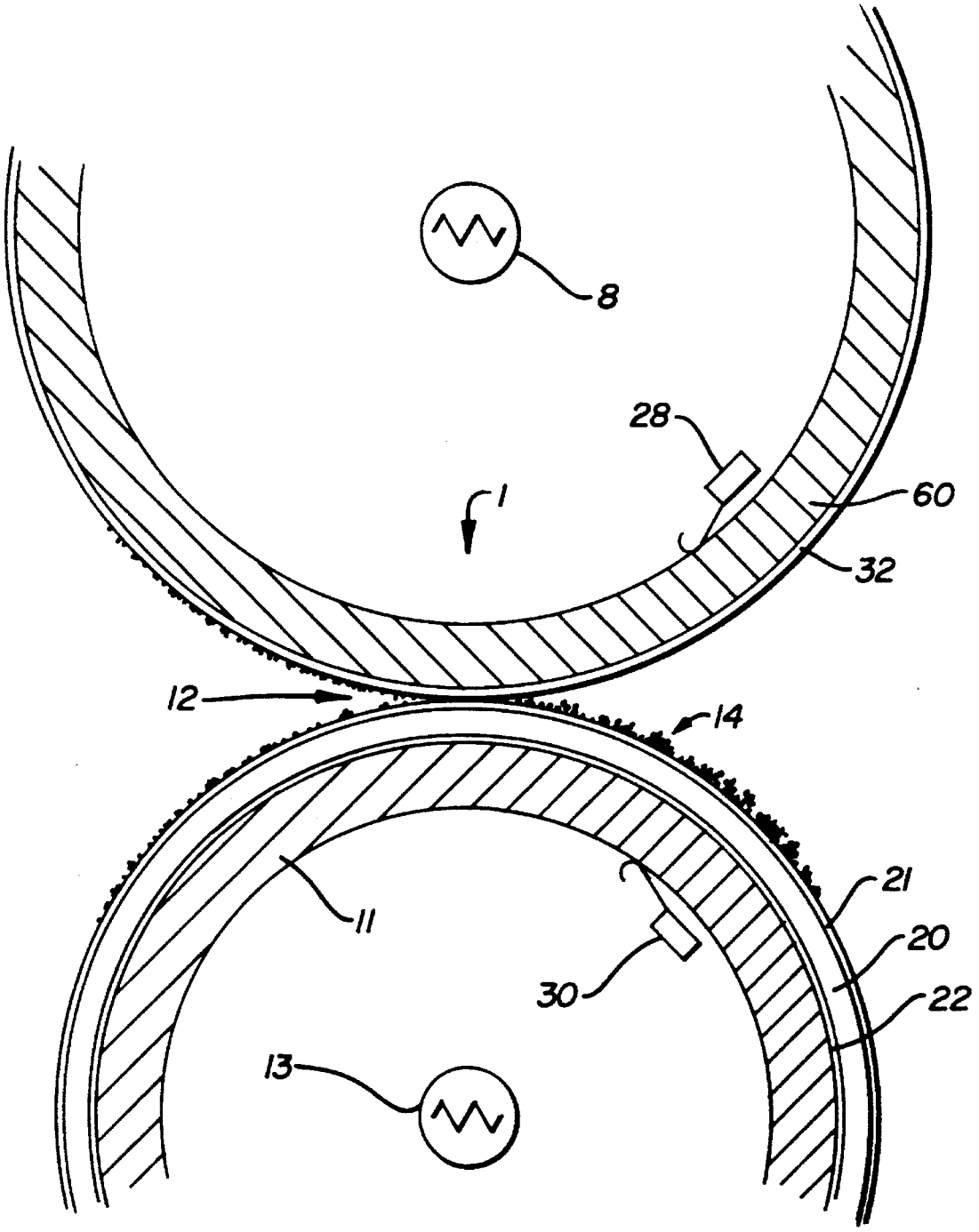
FIG. 2 is a magnified cross-section of the transfer nip of the apparatus shown in FIG. 1 with the thickness of some thin layers exaggerated for illustrative purposes.

Transfer itself is best illustrated in FIG. 2 in which drums 1 and 11 are shown substantially magnified. Image member 1 includes a metallic substrate 60 upon which has been coated a thin photoconductive layer 32. Other layers described more thoroughly in the above-mentioned U.S. Pat. Nos. 4,968,578 and 4,927,727 may also be included.

A typical inverse composite organic photoconductor suitable for use in a quality color process can be heated to between 30 and 45 degrees C. without its dark decay reaching an unacceptable level. Similarly, a temperature of between 30 and 45 degrees C. wall not cause a typical polyester toner having a glass transition temperature between 45 and 60 degrees C. to melt as it moves from the toning station to the transfer nip. For that reason, lamp 8 is controlled by sensor 28 to maintain image member 1 at between 30 and 45 degrees C.

Transfer roller or drum 11 is also a metallic cylinder to which receiving sheet 14 is attached. A heat sensor 30 is used to maintain drum 11 at a temperature of approximately 100 degrees C. Control of the temperatures of both drums 1 and 11 by sensors 28 and 30 is greatly facilitated by the fact that neither drum has a compliant outer layer which would be less conductive of heat than would be the metal shown in FIG. 2. With such a design, control of the temperature of photoconductive layer 32 and receiving sheet 14 can be maintained quite precisely. Receiving sheet 14 has a paper substrate 20 and a heat softenable outer layer 21 formed of a polyester, polystyrene, or other similar material having a glass transition temperature of between 45 and 60 degrees C. On the surface of substrate 20 opposite heat softenable layer 21 is a curl preventing layer 22, preferably of a plastic that can easily be balanced for curl with the heat softenable layer 21 but which has a considerably higher melting point. For example, layer 22 can be made of a polyethylene or polypropylene or other thermoplastic having a melting temperature of 115 degrees C. or greater. Its thickness would be chosen to counter the curl tendency of the receiving sheet caused by the heat softenable layer 21.

If imaging member 1 is unheated and approaches the nip at ambient temperature, it has a tendency to immediately cool the heat softenable layer 21. The toner carried by image member 1 is also at ambient temperature and requires somewhat more heat to produce the desired sintering of the toner particles where such particles touch each other. The toner also has a cooling effect on heat softenable layer 21. To overcome these effects by heating layer 21, we have found it necessary to maintain the receiving sheet 14 at a temperature in excess of 110 degrees C. for many desirable materials. At that temperature, the heat from the receiving sheet will heat the toner to its sintering point as well as adequately soften heat softenable layer 21 to provide efficient transfer. However, difficulties with blistering of receiving sheet 14 are encountered at a temperature above approximately 110 degrees C. These problems can be dealt with in part by other means, for example, drying out the receiving sheet prior to use, etc. In general, however, the other means have other negative effects and are preferably not used.

With the image member 1 heated by lamp 8 to a temperature of between 30 degrees and 45 degrees C., the image member and the toner have less cooling effect on heat softenable layer 21 and the toner itself is closer to its glass transition temperature. We have found that roller 11 can be maintained at a temperature of 100–110 degrees C. and substantially the same results will be obtained in terms of efficiency and quality of transfer as with roller 11 at 110–120 degrees C. and image member 1 unheated.

A difference in the temperature of receiving sheet 14 of 10 or so degrees at about 110 degrees C., is extremely important to the tendency of receiving sheet 14 to blister. Thus, the phenomenon of blistering is greatly reduced with a heated image member 1.

The temperature to which image member 1 is to be heated is largely controlled by the characteristics of photoconductive layer 32. If a particular photoconductive element exhibits unacceptable dark decay of charge at a lower or higher temperature than 45 degrees C., the temperature to which image member 1 is heated must be adjusted accordingly. At the same time, it is preferable that the toner not soften and increase its tendency to stick to the image member or transfer efficiencies will be reduced. We have found the temperature of between 30 and 45 degrees C. to be appropriate for the materials mentioned above. Obviously those temperatures can be varied with other materials.

A substantial interframe between receiving sheets in the apparatus shown in FIG. 1 could cause substantial heating of image member 1 by drum 11 if the drums are allowed to roll in contact during that time. This approach could be used to heat image member 1. In this instance, for example, two revolutions of both drums in contact with each other could be programmed between formation of multicolor prints. The two unused revolutions would heat image member 1 directly from drum 11 before image formation. However, the difficulties in controlling the temperature of image member 1 when heated by a much warmer transfer drum 11 make this a feasible but less desirable approach to heating image member 1. For a number of reasons, it is preferable that the drums 1 and 11 are not allowed to contact each other when a receiving sheet is not in the nip. Such contact is prevented by a suitable stop mechanism between the supports for the drum. See, for example, U.S. patent application Ser. No. 07/532,831, MULTICOLOR IMAGING APPARATUS WITH IMPROVED TRANSFER MEANS, Johnson, filed Jun. 4, 1990, which shows a suitable apparatus for maintaining a gap between the drums when no receiving sheet is within the nip.

Figure 3:
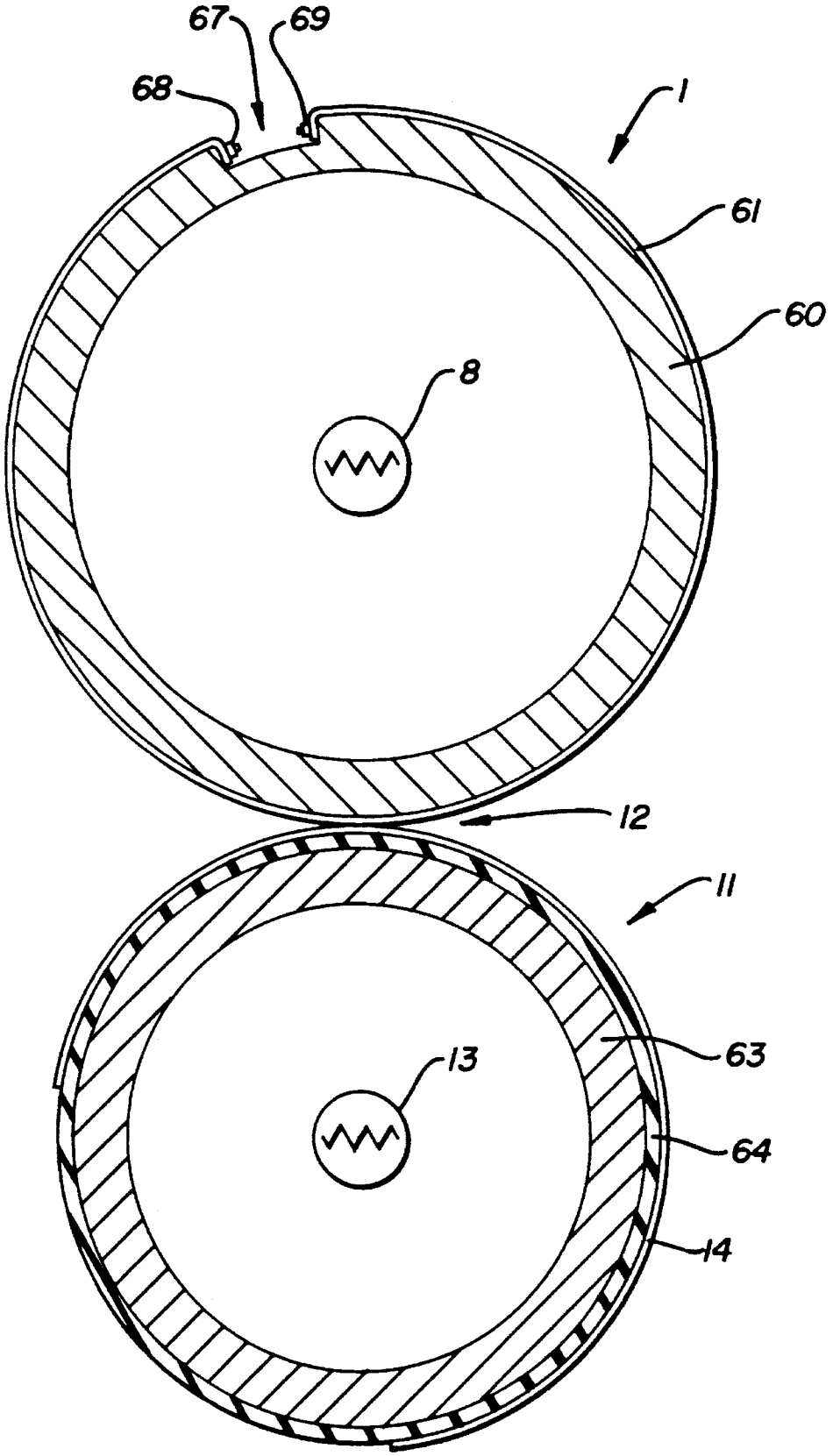
FIG. 3 is a magnified cross section similar to FIG. 2, but illustrating an alternative embodiment of the invention.

FIG. 3 illustrates another embodiment of the invention which utilizes the advantages of the invention to provide a different size and type of nip 12. According to FIG. 3, image member 1 includes a photoconductive sheet 61 which is clamped around a metallic drum 60 by clamps 68 and 69 which also provide electrical continuity with a conductive layer in sheet 61. Sheet 61 can be a conventional seven mil thick sheet including a polyester support, a conductive layer, one or more photoconductive layers and other layers typically making up such an electrophotographic element. This approach of securing a sheet around a drum is known in the art and combines the advantages of a drum in preciseness of imaging with the advantages of a web in replaceability. In this application, the drum configuration also facilitates heating of the sheet 61.

With drum 60 heated internally by lamp 8, receiving sheet 14 need not be heated to as high a temperature as without lamp 8 to maintain heat softenable layer 21 (FIG. 2) above its glass transition temperature and to heat the toner to be transferred. Some of this advantage can be used to provide transfer drum 11 with a thin elastomeric layer 64 on a metallic core 63. Elastomeric layer 64 can be of silicone rubber or polyurethane. It is slightly compliant and makes nip 12 somewhat softer and wider. This softness evens the pressure on the toner particles and helps in heat transfer to the toner. The elastomeric layer is preferably between approximately 1 and 20 mils thick. Although thicknesses outside this range can be used, desired pressure and smoothness is most readily obtainable in this range.

The temperature of layer 64 is not as easy to control in the FIG. 3 embodiment because of the elastomeric layer. It thus has higher peak temperatures than does the FIG. 2 structure. However, heating image member 1 independently of transfer drum 11, allows transfer drum 11 to have a lower aim temperature than without drum 1 being heated, thereby permitting use of a transfer drum less easier to control, which drum has the advantages of compliance mentioned. Heating drum 1 increases the temperature latitude of the transfer drum with respect to blistering because the transfer drum can be run at a nominally lower temperature.

Alternatively, the photoconductive drum 1 can be made slightly compliant. The FIG. 3 version of the photoconductive drum with the photoconductor in sheet form and wrapped around the drum facilitates this embodiment. Compliance can be provided in this structure by putting a 3–12 mil sheet of rubber between the photoconductive sheet, coating an elastomeric material, 1 to 20 mils thick, onto the metallic drum under the photoconductive sheet or applying a similar coating to the rear of the photoconductive sheet. This structure allows more accurate control of the temperature of the transfer drum, leaving it entirely metallic. Control of temperature of the photoconductor is sacrificed to some extent, but in many applications is less critical.

Figure 4:
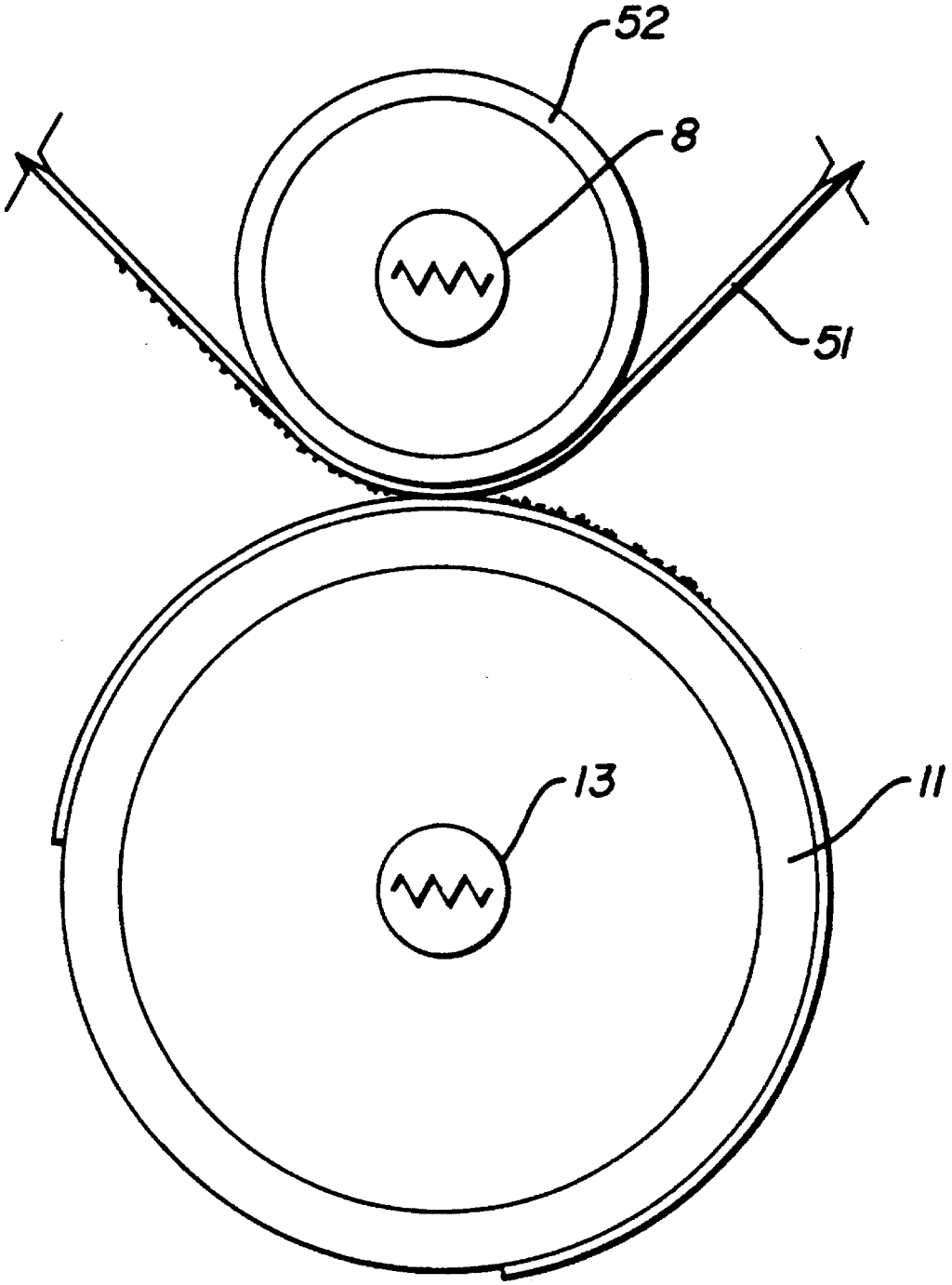
FIG. 4 is a cross-section of a transfer portion of an apparatus similar to that of FIG. 1 illustrating an alternative embodiment of the invention.

FIG. 4 shows an alternative embodiment of the invention in which the invention is applied to an image member 51 which is in the form of a web which is entrained about a heating roller 52 to form an appropriate transfer nip with the transfer roller or drum 11. In this instance, the wrap of image member 51 around heating roller 52 preheats image member 51 to the appropriate temperature as it enters the nip to prevent it from cooling the heat softenable layer 21 and allowing receiving sheet 14 to again be heated only to 100 degrees C. rather than 110 degrees C. where it also would be liable to blister.

EXAMPLE 1

A color image was made by electrophotographically developing electrostatic images representing magenta, cyan, and yellow separations using dry toner particles having median volume weighted diameters between 3 and 4 microns. The image-bearing member consisted of an organic photoconductor which had been coated on an Estar support and tightly wrapped around a stainless steel roller. The receiver consisted of a coated paper support onto which was coated a 10 micron thick polystyrene thermoplastic layer having a glass transition temperature of approximately 56 degrees C., as determined using differential scanning colorimetry. The receiver was wrapped around a metallic transfer drum and heated to 107 degrees C. The temperature of the photoconductor was measured at 25 degrees C. This resulted in a receiver-photoconductor interface temperature of approximately 66 degrees C. Mottle was observed in the transferred image, corresponding to incomplete transfer.

EXAMPLE 2

This example is similar to Example 1 except that the photoconductor was heated to 37 degrees C. This resulted in an interfacial temperature of 72 degrees C. Transfer was very good, with no observable mottle and little residual toner. When such an interfacial temperature is obtained with the photoconductor drum at 25 degrees C., as in Example 1, the receiver must be heated to 118 degrees C. Depending somewhat on the moisture content of the receiver, blistering often occurs at this temperature, but much less often at 107 degrees C.

Although this invention is particularly usable with receiver sheets that have a heat softenable layer for receiving toner as described, it can be used in heat assisted transfer of toner to other receiving sheets as well, including plain bond paper.

Although all of the embodiments shown in the Figs. show the drums 1 and 52 heated internally, they could be heated externally, for example, using radiation or a heated contact roller. In general, internal heating has the advantage of not contacting the photoconductive surface or attempting to heat through toner. It is therefore preferred.

The invention has been described in detail with particular reference to a preferred embodiment thereof, but it will be understood that variations and modifications can be effected within the spirit and scope of the invention as described hereinabove and as defined in the appended claims.

We claim:

1. A method of transferring a toner image made up of sinterable toner particles from an image bearing surface of an image member to a receiving sheet, said receiving sheet including a substrate of a material having a tendency to contain moisture, said substrate having a first thermoplastic layer which is heat softenable on one side of the substrate and a second layer on the other side of the substrate, both said first and second layers having a tendency to resist escape of moisture from the substrate, said method comprising:

passing said image member through a transfer zone while backed by or coated on a first drum, passing said receiving sheet through said transfer zone with said image receiving surface in pressure contact with said toner image while backed by a second drum, heating the image member to a temperature entering the transfer zone substantially above ambient temperature but less than the temperature at which the toner has a tendency to stick to the image member, and heating said receiving sheet to a temperature sufficient to both soften the first thermoplastic layer and at least sinter the toner particles where they touch each other to cause transfer of the toner to the thermoplastic layer in the transfer zone.

2. A method of transferring a toner image from an image-bearing surface of an image member, which image member has at least one photoconductive layer, to a receiving sheet which receiving sheet includes a substrate having a tendency to contain moisture and a first thermoplastic layer on one side of the substrate which thermoplastic layer is heat softenable and a second thermoplastic layer opposite said first thermoplastic layer, said method comprising:

passing said image member and receiving sheet through a transfer zone while applying pressure between the image member and the receiving sheet, heating the receiving sheet to a temperature sufficient to soften the thermoplastic layer and to sinter the toner sufficiently to cause transfer of the toner to the heat softened thermoplastic layer, and heating the image member, independently of the receiving sheet heating step, to a temperature substantially above an ambient temperature but lower than a temperature at which the photoconductive layer exhibits substantial dark decay to thereby reduce the temperature to which the receiving sheet needs to be raised to effect such transfer.

3. The method according to claim 2 wherein the image member is a metallic drum having one or more coatings of a photoconductive material on its periphery and wherein the temperature to which it is heated is between 30 and 45 degrees C.

4. The method according to claim 3 wherein the receiving sheet is maintained at a temperature of approximately 100 degrees C. as it approaches the nip between the receiving sheet and the image member.

5. The method according to claim 2 wherein the receiving sheet is maintained at a temperature of approximately 100 degrees C. as it approaches the nip between the receiving sheet and the image member.

6. The method according to claim 2 wherein the toner has a glass transition temperature between 45 and 70 degrees C. and the first thermoplastic layer has a glass transition temperature between 45 and 60 degrees C.

7. A method of creating multicolor images comprising the steps of:

forming a series of electrostatic images on the surface of an image member having at least one photoconductive layer, toning said series of electrostatic images with different color toners to create a series of different color toner images, transferring said images in registration to a receiving sheet carried by a transfer drum to create a multicolor toner image on the receiving sheet, and fixing the multicolor toner image on the receiving sheet, characterized in that the transfer step includes the steps of heating the transfer drum to a temperature sufficient to cause the toner to sinter and attach itself to the receiving sheet and heating the photoconductive drum, independently of the step of heating the transfer drum, to a temperature substantially above an ambient temperature but less than a temperature causing unacceptable dark decay in the photoconductive layer.

8. A method of transferring a toner image from an image bearing surface of an image member to a receiving sheet, said receiving sheet including a substrate having a tendency to contain moisture, said receiving sheet having outside surfaces having a tendency to blister from the escape of moisture from said substrate, said method comprising:

passing said image member through a transfer zone while backed by or coated on a first drum, a thin layer of compliant material being positioned between said first drum and said image bearing surface, passing said receiving sheet through said transfer zone in pressure contact with said toner image while backed by a second drum, heating the image member to a temperature entering the transfer zone substantially above ambient temperature but less than the temperature at which the toner has a tendency to stick to the image member, and heating said receiving sheet to a temperature sufficient to cause transfer of the toner image to the receiving sheet.

9. The method according to claim 8 wherein said image bearing surface and said layer of compliant material are on separate sheets wrapped around said first drum.

10. The method according to claim 8 wherein said image bearing surface and said layer of compliant material are on opposite sides of a single sheet which is wrapped around said first drum.

11. The method according to claim 8 wherein said layer of compliant material is coated on said first drum.

12. A method of transferring a toner image, said method comprising:

moving an image member through a transfer zone, which image member defines an image bearing surface carrying a toner image and includes a photoconductive layer, a hard backing and a compliant layer between the backing and the photoconductive layer, moving a receiving sheet through the transfer zone into pressure contact with the image bearing surface while backed by a hard, thermally conductive transfer member, and heating the receiving sheet through the hard, thermally conductive transfer member to a temperature sufficient to transfer the toner to the receiving sheet.

13. The method according to claim 12 wherein said image member includes a metallic drum and a sheet wrapped on said drum, said sheet including a support having the photoconductive layer and the compliant layer affixed to opposite sides of the support with the compliant layer contacting the drum.

* * * * *